US006885835B2

(12) United States Patent
Seo

(10) Patent No.: US 6,885,835 B2
(45) Date of Patent: Apr. 26, 2005

(54) DEVICE FOR CUTTING OFF POWER SUPPLY OF PRINTER

(75) Inventor: In-sik Seo, Gyeonggi-do (KR)

(73) Assignee: Samsung Electronics Co., LTD, Suwon-Si (KR)

( * ) Notice: Subject to any disclaimer, the term of this patent is extended or adjusted under 35 U.S.C. 154(b) by 0 days.

(21) Appl. No.: 10/647,136

(22) Filed: Aug. 25, 2003

(65) Prior Publication Data

US 2004/0105695 A1 Jun. 3, 2004

(30) Foreign Application Priority Data

Aug. 24, 2002 (KR) ..... 10-2002-0050303

(51) Int. Cl.[7] ..... G03G 15/00; G03G 21/00

(52) U.S. Cl. ..... 399/88; 399/37; 399/90; 399/110; 399/119

(58) Field of Search ..... 399/37, 88, 90, 399/119, 120, 124, 125, 107, 110, 111; 347/138, 152

(56) References Cited

U.S. PATENT DOCUMENTS 6,091,912 A * 7/2000 Kitajima et al. ..... 399/119 X
6,125,251 A * 9/2000 Shiraishi et al. ..... 399/124
6,647,223 B1 * 11/2003 Ishii ..... 399/90
2002/0127028 A1 * 9/2002 Amano ..... 399/88

FOREIGN PATENT DOCUMENTS

| | | | |
|---|---|---|---|
| JP | 62-209547 | * | 9/1987 |
| JP | 06-083130 | * | 3/1994 |
| JP | 08-278836 | | 10/1996 |
| KR | 91-5642 | | 4/1991 |

* cited by examiner

*Primary Examiner*—Sophia S. Chen
(74) *Attorney, Agent, or Firm*—Staas & Halsey LLP

(57) ABSTRACT

A device for cutting off a power supply of a printer. The device for cutting off the power supply of the printer, wherein the printer includes a developer unit and a printer cover covering an opening provided for replacing the developer unit, includes a first unit cutting off power supply on the developer unit, and a second unit cutting off power supply on the surface of the printer cover opposite to the developer unit to correspond to the first unit. Since the volume of the device for cutting off the power supply is reduced, the size of the printer can be reduced. Also, the number of failures generated when assembling the elements of the device and problems generated when operating the device can be greatly reduced.

17 Claims, 8 Drawing Sheets

DEVICE FOR CUTTING OFF POWER SUPPLY OF PRINTER

CROSS-REFERENCE TO RELATED APPLICATION

This application claims the benefit of Korean Patent Application No. 2002-50303, filed on Aug. 24, 2002, in the Korean Intellectual Property Office, the disclosure of which is incorporated herein by reference.

BACKGROUND OF THE INVENTION

1. Field of the Invention

The present invention relates to a printer, and more particularly, to a device for cutting off a power supply of a printer.

2. Description of the Related Art

Users of output apparatuses such as laser beam printers (LBPs) can add desired functions to the output apparatuses other than functions basically provided to thereto. For example, a user can additionally mount expansion boards, a ROM board, or an interface board for use with a network. Also, a developer unit used in an output apparatus must be routinely replaced after a tower therein has been exhausted. In these cases, since a printer cover is opened when the board or the developer unit is mounted in the printer body, a current flowing through a circuit of the printer body must be cut off to protect the user.

When opening the printer cover of a conventional apparatus, the above operations are performed after separately cutting off a voltage (5V) of a laser scanning unit and a voltage (25V) required to drive a motor of the printer, or by cutting off a main power supply of the printer.

As described above, where a device for cutting off the power supply is not individually installed in the printer, or the power supply is cut off by respectively turning off multiple switches which are separately located in several positions of the printer when opening the printer cover, there is a problem in that the process for cutting off the power supply is complex and possibly unsafe.

To solve the above-described problems, various devices for cutting off the power supply of the printer have been proposed. FIG. 1 shows a basic configuration of one among the conventional devices for cutting off the power supply of the printer.

Referring to FIG. 1, a device for cutting off a power supply of a printer according to the related art includes a bracket 20 mounted on an upper frame 10 of the printer, an actuator 30 of which a lever contact end 32 and a switch contact end 33 are extended from both sides of a hinge axis 21 so as to oppose each other with respect to the hinge axis 21 on a proper position of the bracket 20. A micro switch 40 is installed within a turning radius of the switch contact end 33 of the actuator 30 on the bracket 20. One end of an elastic body 50 is fixed in position at the lever contact end 32 of the actuator 30 and the other end is fixed in to the bracket 20, so that the elastic body 50 always pulls the lever contact end 32 upward with respect to the hinge axis 21.

The hinge axis 21 is formed on the bracket 20 and a hinge hole 31 is provided in the center of the actuator 30, so that the actuator 30 can be combined to the bracket 20. The actuator 30 is one piece such that the lever contact end 32 is extended from the hinge hole 31 toward one end of the actuator 30, and the switch contact end 33 is extended from the hinge hole 31 toward the other end. Thus, when the lever contact end 32 moves downward, the switch contact end 33 moves upward.

The micro switch 40, connected to a power supply unit of a main body of the printer, is contacted by the switch contact end 33 of the actuator 30. The micro switch 40 is fixed on a printed circuit board 41, and the printed circuit board 41 is fixed on the upper surface of the bracket 20 by a screw, etc.

A tension coil spring 50 is used as an elastic body, and both ends thereof are fixed to fixed parts 32*a* and 20*a* in the actuator 30 and the bracket 20, respectively. The tension coil spring 50 pulls the lever contact end 32 of the actuator 30 so as to be in an upward position.

Referring to FIG. 2, when completely closing a front cover 60 provided for opening and closing a printer, a lever 61 on an inner surface of the front cover 60 is provided so that when the cover 60 is closed the lever 61 is within a turning radius of the lever contact end 32.

As shown in FIG. 2, in a case where a developer unit 70 is not mounted in the printer, the lever contact end 32 of the actuator 30 is pulled upward by the tension coil spring 50, thereby separating the micro switch 40 from the switch contact end 33 by a constant distance. At this time, although the lever 61 of the front cover 60 is in a closed state (referred to as an A state in FIG. 2), the lever 61 cannot be positioned so as to interfere with the motion of the actuator 30. Thus, the micro switch 40 cannot be connected to the power supply unit of the printer, and the supply of power to the printer is in an 'OFF' state.

As shown in FIG. 3, when the developer unit 70 is mounted into the printer, an upper surface 71 of the developer unit 70 pushes a lower surface of the switch contact end 33 of the actuator 30 upward. When the developer unit 70 has been mounted completely, the switch contact end 33 of the actuator 30 is moved upward more than the position thereof shown in FIG. 2, but not in a position of contact with the micro switch 40. Simultaneously, the lever contact end 32 is moved downward, so that the lever 61 can interfere with the lever contact end 32 (referred to as an A state in FIG. 3), when closing the front cover 60. In this case, since the micro switch 40 is not connected to the power supply unit of the printer, the power supply of the printer is in an 'OFF' state.

Sequentially, as shown in FIG. 4, if the front cover 60 is closed after completely mounting the developer unit 70, the lever 61 of the front cover 60 pushes the lever contact end 32 of the actuator 30 downward, and simultaneously the switch contact end 33 moves upward so that the micro switch 40 is connected to the power supply unit of the printer. At this time, the switch contact end 33 is separated from the upper surface 71 of the developer unit 70 and is supported by the end of the lever 61. In this case, since the micro switch 40 is connected to the power supply unit of the printer, the printer is turned 'ON', and the printer normally operates.

If the developer unit 70 is separated from the main body of the printer while replacing the developer unit 70 after opening front cover 60, the lever contact end 32 receives a tension force from the tension coil spring 50 as shown in FIG. 3 and FIG. 2. As a result, the power supply of the printer is automatically switched to an 'OFF' state.

In the devices for cutting off the power supply of the printer according to the related art, since the conventional devices have a large number of elements, the size of the devices are necessarily large, thereby increasing the size of the printer. Consequentially, it is difficult to obtain a compact and small printer. In addition, with an increase in number of elements, the probability of malfunction increases.

As described above, the structure of the device for cutting off the power supply of the printer according to the prior art is complicated. Also, since the actuator must operate both when the developer unit is replaced and when the front cover is manipulated, problems may be generated in actuator operation.

SUMMARY OF THE INVENTION

The present invention provides a small and compact device for cutting off a power supply of a printer and having a reduced number of elements, thereby decreasing a probability of the device to malfunction in an element assembling process and reducing errors in operation.

According to an aspect of the present invention, there is provided a device cutting off the power supply of a printer including a developer unit and a printer cover covering an opening provided for replacing the developer unit. The device includes a first unit cutting off the supply of power provided to the developer unit, and a second unit cutting off the supply of power on the surface of the printer cover opposite to the developer unit so as to correspond to the first unit.

According to an aspect of the invention, the first unit is a first protuberance formed so as to oppose the printer cover when the printer cover is closed when the developer unit is mounted in the printer. The second unit is a first power supply cutting-off module including a cap having a first insertion hole, into which the first protuberance is insertable, and a switch module turned to an 'ON' state when the first protuberance is inserted into the first insertion hole. The first protuberance is provided in a corner of the developer unit, and the first power supply cutting-off module is provided in the printer cover such that the first protuberance corresponds to the first insertion hole.

According to another aspect of the present invention, the second unit is a second protuberance formed so as to oppose the developer unit when the printer cover is closed after a developer unit is mounted in the printer. The first unit is a second power supply cutting-off module including a cap having a second insertion hole, into which the second protuberance is insertable, and a switch module which is turned to an 'ON' position when the second protuberance is inserted into the second insertion hole. The second power supply cutting-off module is provided in the corner of the developer unit, and the second protuberance is provided in the printer cover corresponding to the second insertion hole.

According to another aspect of the present invention, the first unit is a plurality of protuberances formed so as to oppose the printer cover. The second unit is a power supply cutting-off module including a cap having a plurality of insertion holes, into which the plurality of protuberances are inserted, and a switch module which is turned 'ON' when the plurality of protuberances are inserted into the plurality of insertion holes. The plurality of protuberances are separated from one another, and the power supply cutting-off module includes a plurality of power supply cutting-off module corresponding to the plurality of separated protuberances, respectively.

According to another aspect of the present invention, the second unit is a plurality of protuberances so as to oppose the developer unit. The first unit is a power supply cutting-off module including a cap having a plurality of insertion holes, into which the plurality of protuberances are inserted, and a switch module which is turned 'ON' when the plurality of protuberances are inserted into the plurality of insertion holes. The plurality of protuberances are separated from one another, and the power supply cutting-off module includes a plurality of power supply cutting-off modules corresponding to the plurality of separated protuberances, respectively.

By applying the present invention, since the volume of the device for cutting off the power supply is reduced, the volume of the printer can be reduced, and the number of failures generated when assembling the elements included in the device and problems generated when operating the device can be reduced.

Additional aspects and advantages of the invention will be set forth in part in the description which follows and, in part, will be obvious from the description, or may be learned by practice of the invention.

BRIEF DESCRIPTION OF THE DRAWINGS

These features and/or other aspects and advantages of the invention will become apparent and more readily appreciated from the following description of the embodiments taken in conjunction with accompanying drawings in which.

DETAILED DESCRIPTION OF THE INVENTION

Figure 1:
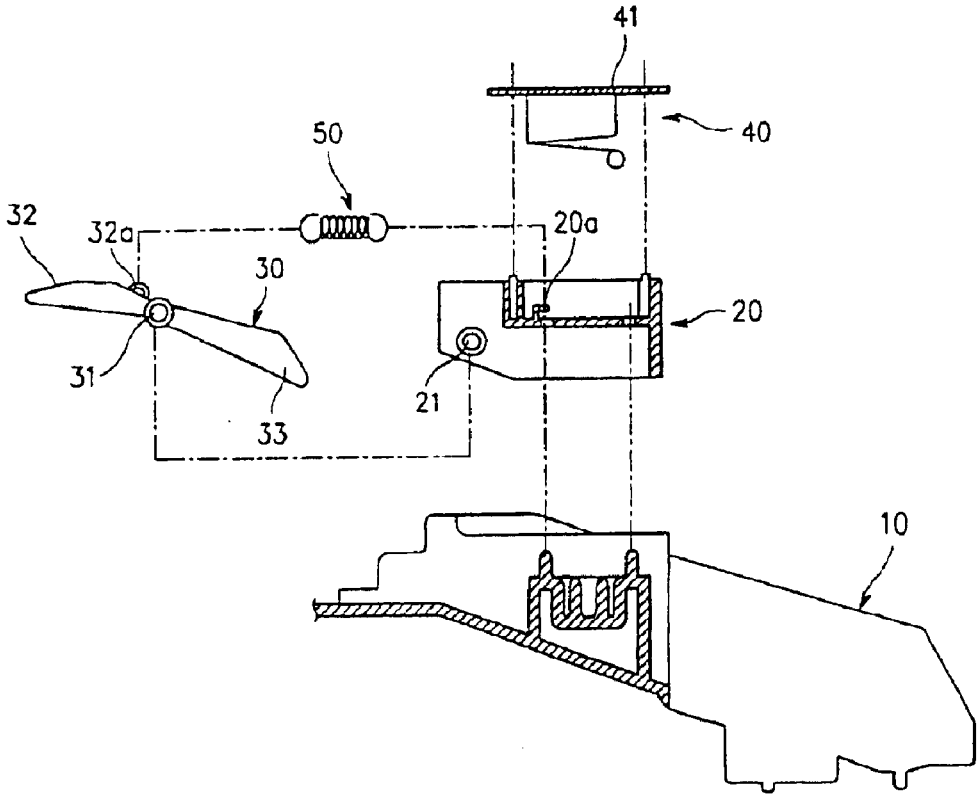
FIG. 1 (PRIOR ART)
FIG. 1 is a configuration diagram showing a conventional device for cutting off a power supply of a printer.
Figure 2:
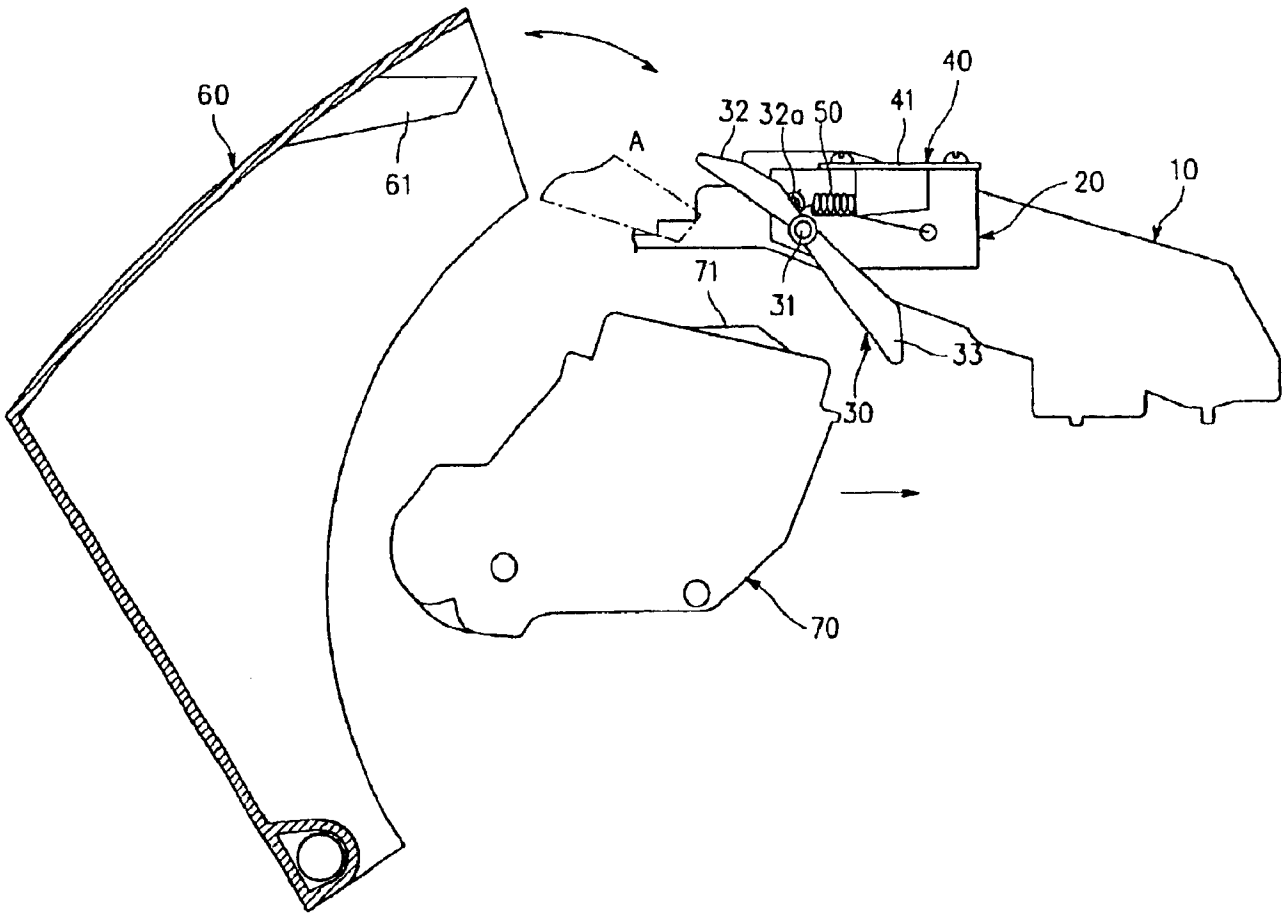
FIG. 2 (PRIOR ART)
FIG. 2 is a configuration diagram showing a state of an actuator before mounting a developer unit according to the prior art.
Figure 3:
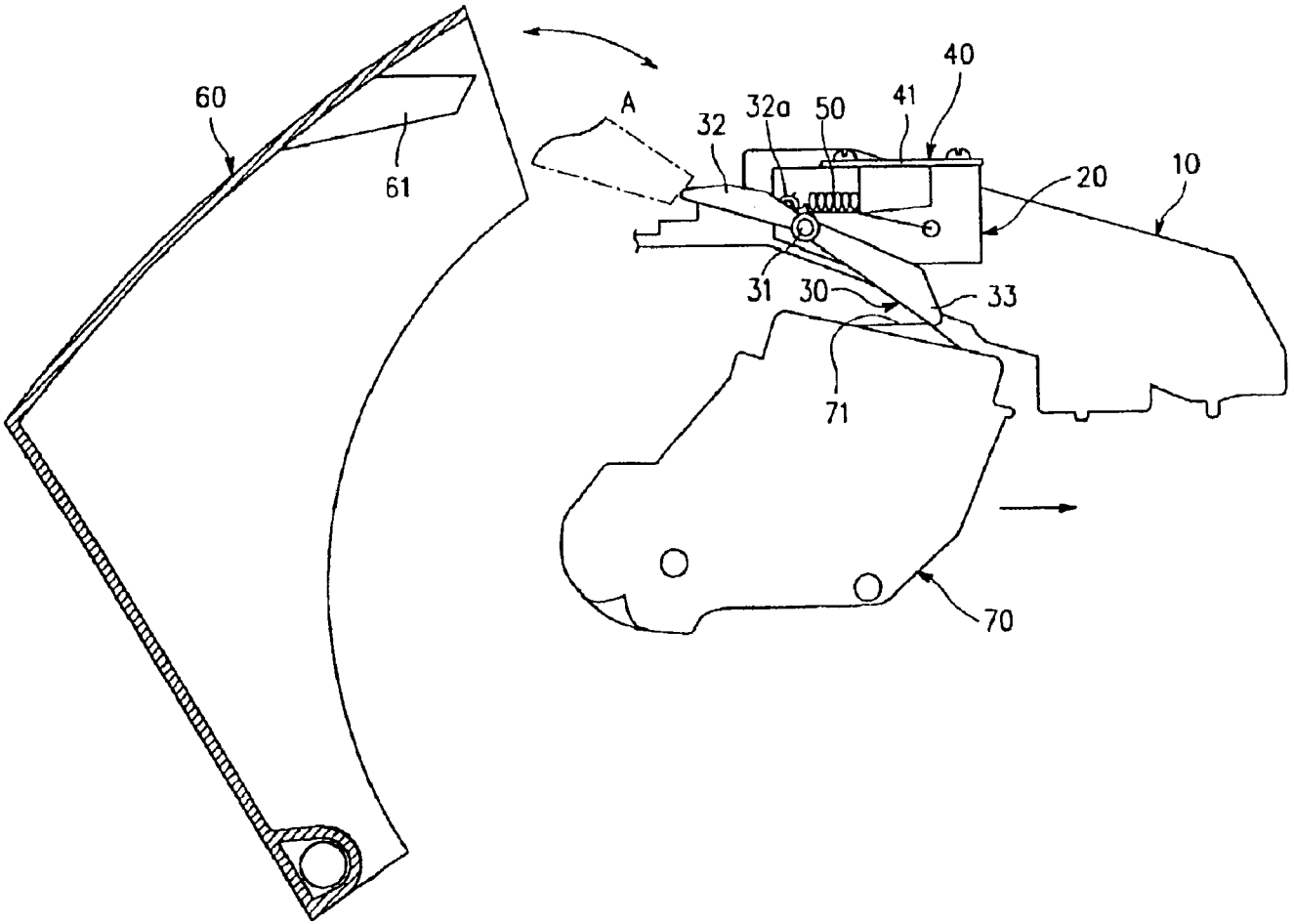
FIG. 3 (PRIOR ART)
FIG. 3 is a configuration diagram showing a state of the actuator after mounting the developer unit shown in FIG. 2.
Figure 4:
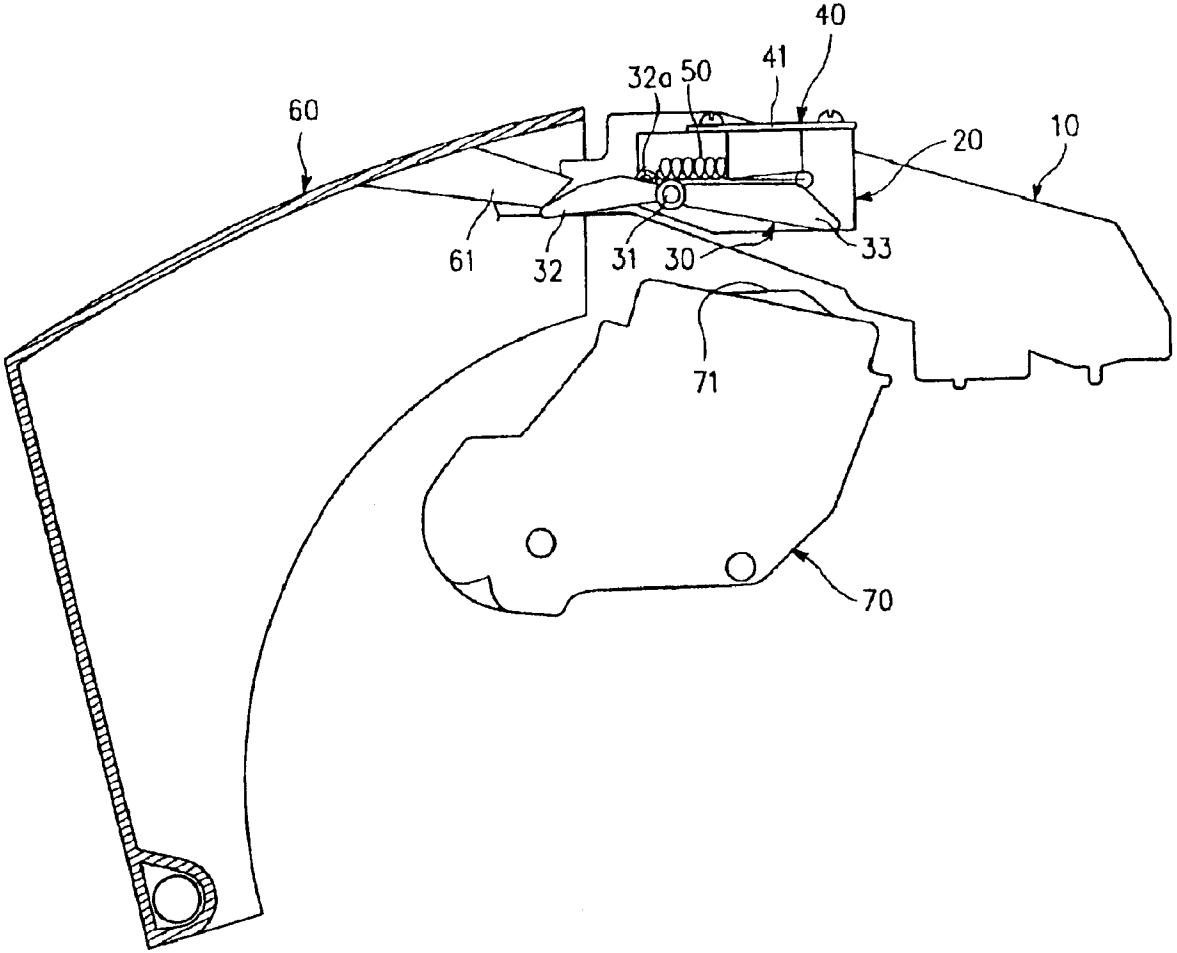
FIG. 4 (PRIOR ART)
FIG. 4 is a diagram showing a state of the actuator shown in FIG. 3 after closing the printer cover after mounting the developer unit.

Reference will now be made in detail to the embodiments of the present invention, examples of which are illustrated in the accompanying drawings wherein like reference numerals refer to the like elements throughout. The embodiments are described below in order to explain the present invention by referring to the figures.

In the drawings, the thickness of layers and regions are exaggerated for clarity.

Figure 5:
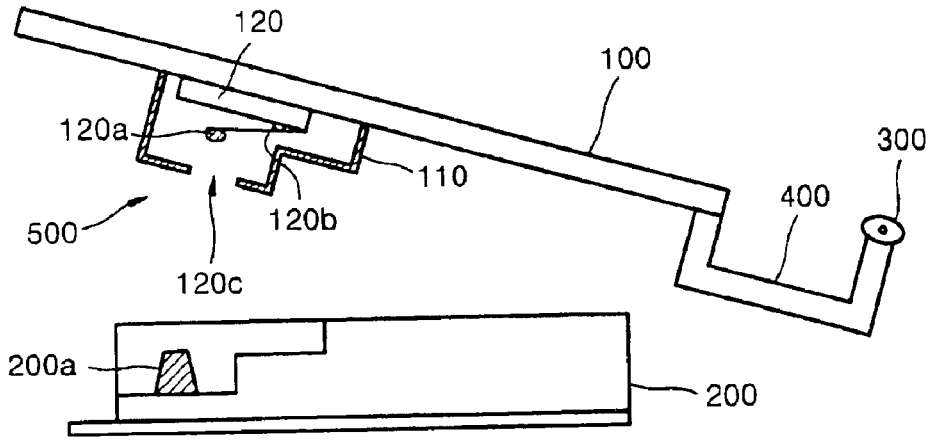
FIG. 5 is a side view of a developer unit and a printer cover including a device for cutting off a power supply of a printer according to an embodiment of the present invention.

FIG. 5 is a side view of a device for cutting off a power supply of a printer (hereinafter referred to as a power supply cutting-off module) according to one embodiment of the present invention. Here, reference numbers 100 and 200 represent a printer cover and a developer unit, respectively. The printer cover 100 covers an opening allowing replacement of the developer unit 200 of a printer. One side of the cover 100 is connected to a hinge 300 through a connecting member 400. Thus, the cover 100 is movable within a predetermined range with respect to the hinge 300. A first power supply cutting-off module 500 is provided on a surface of the cover 100 opposite to the developer unit 200.

The power supply cutting-off module 500 cuts off the power supply when the cover 100 is opened, the developer unit 200 is separated from the printer, or the developer unit 200 is not completely mounted in the printer. Thus, since the power supplied to the printer is cut off in the above cases, a user can safely work.

The first power supply cutting-off module 500 includes a switch module 120 mounted to the printer cover 100 cutting off the power supplied to the printer in response to an external reaction, a switch 120*a* operating the switch module 120, a power supply cutting-off button 120*b* transferring the operation of the switch 120*a* to the switch module 120 to cut off the power supply, and a cap 110 protecting the above elements.

One end of the switch 120*a* is connected to a surface (hereinafter, referred to as a switch module surface) of the switch module 120 opposite to the surface adhered to the printer cover 100. As used herein, the switch module surface is referred to as a surface of the switch module 120 opposite to the developer unit 200 when the printer cover 100 is closed. The other end of the switch 120*a* extends from the connecting point of the end of the switch 120*a* over the switch module surface by a predetermined distance so as to be separated from the switch module surface by a given distance.

A power supply cutting-off button 120*b* is formed between the switch 120*a* and the switch module 120. The power supply cutting-off button 120*b* is formed between the switch 120*a* and the switch module surface so that the button 120*b* is elastically connected to the switch module 120. Thus, the switch 120*a* is pressed, the power supply cutting-off button 120*b* is simultaneously pressed so that the power is supplied to the printer. In contrast, when switch 120*a* is released, power supplied to the printer is cut off. Since the button 120*b* is made of an elastic member such as a spring, when a force pressing the button 120*b* is removed, the button 120*b* is returned to an original state so that the power supplied to the printer is immediately cut off.

A first protuberance 200*a* included in the developer unit 200 switches the switch 120*a* to an 'ON' position, that is, presses the switch 120*a* while the cover 100 is closed with the developer unit 200 mounted in the printer. The first protuberance 200*a* is formed on a given area of the developer unit 200 corresponding to the switch 120*a*, and having a predetermined length.

An area of the developer unit 200 opposite to the first power supply cutting-off module 500 corresponds to the geometry of the cap 110 of the first power supply cutting-off module 500. That is, the cap 110 is divided into a portion corresponding to the first protuberance 200*a* (hereinafter referred to as a first portion) and a portion extended toward the hinge 300 (hereinafter referred to as a second portion). The first portion of the cap 110 protrudes more than the second portion. To fit the cap 110, an area of the developer unit 200 corresponding (to be referred to as the forming area of the first protuberance 200*a*) to the first portion of the cap 110 is deeper than an area of the developer unit 200 corresponding to the second portion of the cap 110. Thus, the area corresponding to the cap 110 of the developer unit 200 is formed in a step-shape. It can be clearly seen from FIG. 6 that when closing the printer cover 100, the cap 110 accurately matches this area of the developer unit 200.

Figure 6:
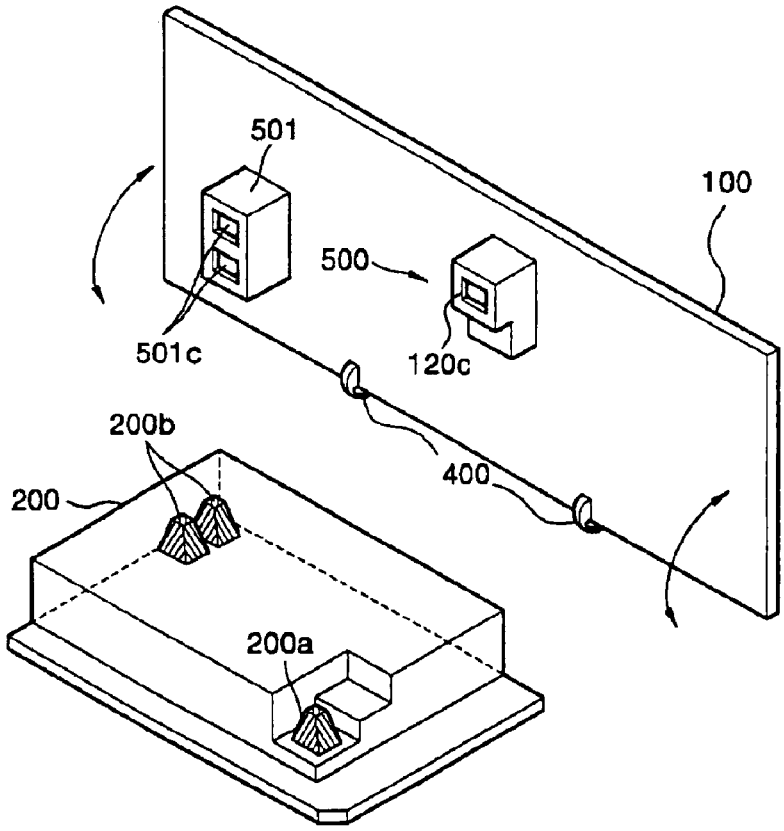
FIG. 6 is a perspective view of a state in which the printer cover is opened, in the device for the cutting off the power supply of the printer shown in FIG. 5.

Although the first protuberance 200*a* is shown formed in an area including the corner of the right lower end of the developer unit 200 in FIG. 6, the forming area of the first protuberance 200*a* is not limited thereto. For example, the first protuberance 200*a* may be formed in an area including the corner of the left lower end of the developer unit 200 or in the center of the left lower end of the developer unit 200. The first power supply cutting-off module 500 is formed on the printer cover 100 so as to match the geometry of the area surrounding the first protuberance 200*a*.

In FIGS. 5 and 6, a reference numeral 120*c* represents a first insertion hole formed on the cap 110. The first insertion hole 120*c* is formed in an area corresponding to the first protuberance 200*a* of the cap 110 when the printer cover is closed. When closing the cover 100, for example, after mounting the developer unit 200, the first protuberance 200*a* is inserted into the first insertion hole 120*c*. In a case where the developer unit 200 is not completely mounted in the printer, the first protuberance 200*a* and the first insertion hole 120*c* are not accurately aligned. As a result, the first protuberance 200*a* is not fully inserted into the first insertion hole 120*c*. Accordingly, power is not supplied to the printer.

Figure 7:
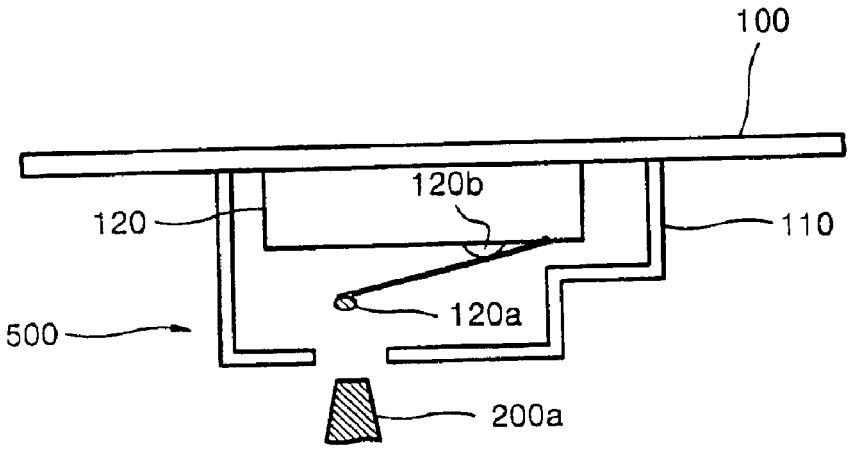
FIG. 7 is a cross-sectional view of a state in which the printer cover is opened, in the device for cutting off the power supply of the printer shown in FIG. 5.
Figure 8:
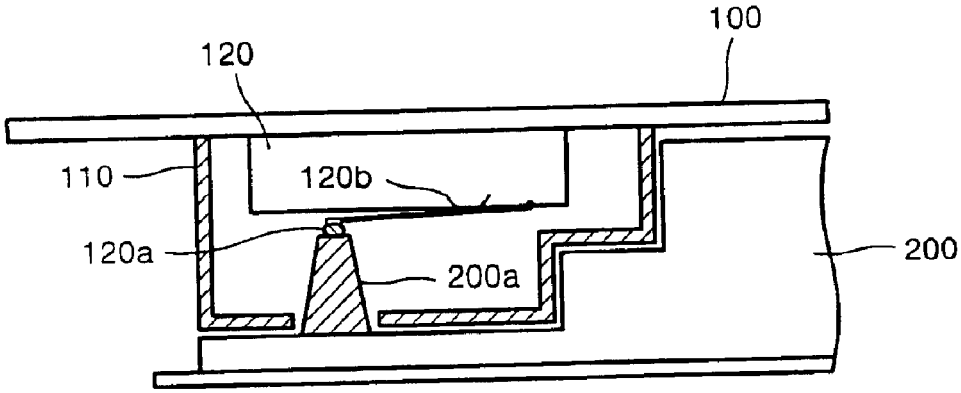
FIG. 8 is a cross-sectional view of a state in which the printer cover is closed, in the device for cutting off the power supply of the printer shown in FIG. 5.

FIG. 7 shows a case in which the first protuberance 200*a* is not in contact with the switch 120*a*, that is, the printer cover 100 is open. FIG. 8 shows a state in which the printer cover 100 is closed after mounting the developer unit 200.

Referring to FIG. 7, when the printer cover 100 is opened, since the developer unit 200 and the printer cover 100 are separated from each other, the first protuberance 200*a* is outside the first power supply cutting-off module 500. Thus, the switch 120*a* does not receive any exterior force applied to the switch module 120. Although the switch 120*a* is subjected to a gravity force, the gravity force affecting the switch 120*a* is applied not to the switch module 120 but to the developer unit 200. The switch 120*a* is mounted so as to be able to be turned by a predetermined angle in a case where one end of the switch 120*a* is connected to the switch module 120. For this reason, when opening the printer cover 100, the other end of the switch 120*a* is separated from the switch module surface as much as possible.

If the printer cover is opened, the external force applied to the switch 120*a* substantially toward the switch module 120 is removed. The power supply cutting-off button 120*b*, connected to the inside of the switch module 120 through the switch module surface, and having an elasticity so as to be always contacted to the switch 120*a* and located between the switch 120*a* and the switch module 120, protrudes through the switch module surface. Thus, the power supplied to the printer is cut off and the operation of the printer is stopped. The power supply cutting-off button 120*b* protruded from the switch module 120 through the switch module surface is still in contact with the switch 120*a* that is separated from the switch module surface a maximum amount.

When the printer cover 100 is closed, after mounting the developer unit 200 as shown in FIG. 8, the first protuberance 200*a* is inserted into the first power supply cutting-off module 500 through the first insertion hole 120*c* formed in the cap 110. The first protuberance 200*a* inserted into the first power supply cutting-off module 500 contacts with the other end of the switch 120*a* and applies a predetermined force to the switch 120*a*. Thus, the predetermined force is transferred to the switch module 120 through the switch 120*a*. By the above predetermined force, the switch 120*a* is pressed toward the switch module 120, and a distance between the other end of the switch 120*a* and the switch module 120 decreases. As described above, by pressing the switch 120*a*, the force applied to the switch module 120 through the switch 120*a* is transferred to the power supply cutting-off button 120*b*. By the pressing of the power supply cutting-off button 120*b* by the switch 120*a*, the switch module 120 is turned to an 'ON' position so that power is supplied to the printer.

Figure 9:
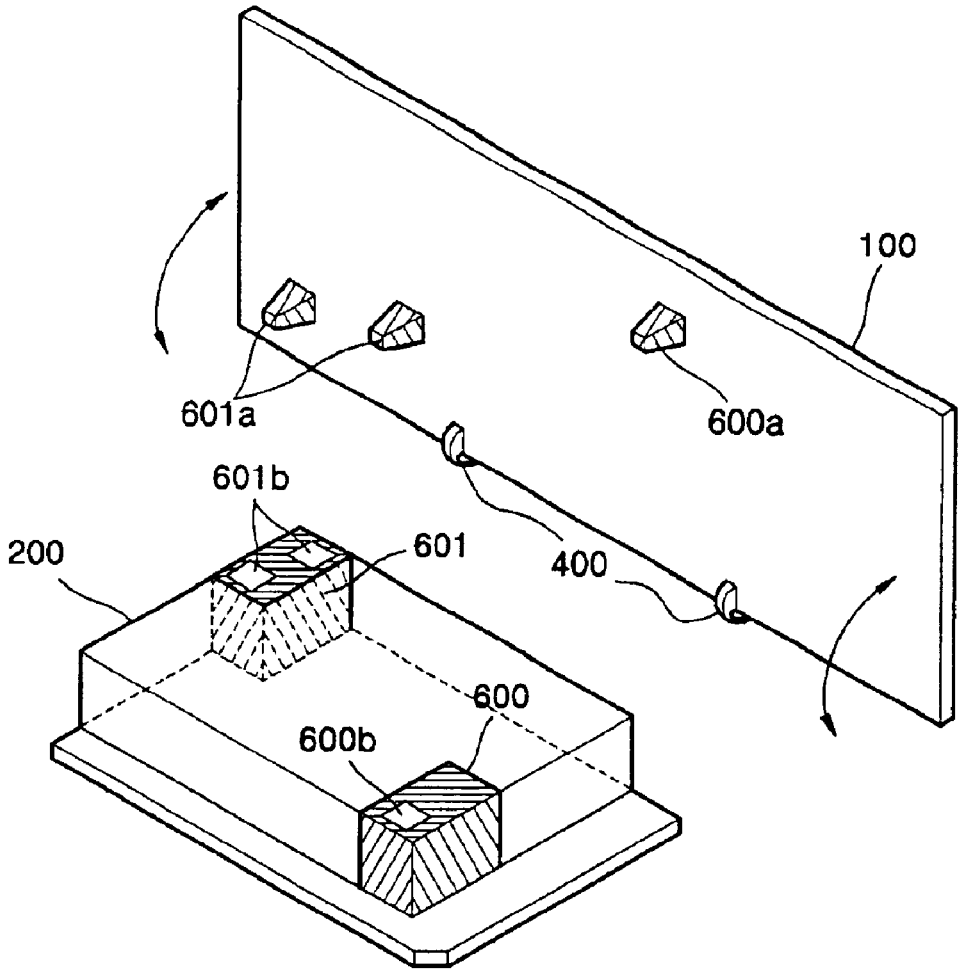
FIG. 9 is a perspective view of a device for cutting off a power supply of a printer according to another embodiment of the present invention.

FIG. 9 shows a configuration of a device for cutting off the power supply of a printer according to another embodiment of the present invention. The device shown in FIG. 9 has an alternative configuration with respect to the device described in the previous embodiment.

Specifically, referring to FIG. 9, a second protuberance 600*a* is formed on a surface of a printer cover 100 opposite to a developer unit 200. A second power supply cutting-off module 600 having a second insertion hole 600*b*, into which the second protuberance 600*a* is inserted, is provided in the developer unit 200. The second power supply cutting-off module 600 can have the same configuration as the above-described first power supply cutting-off module 500 (refer to FIG. 5), or the second power supply cutting-off module 600 may have a different configuration. The second power supply cutting-off module 600 may be provided in the same area as the above-described first protuberance 200*a* (refer to FIG. 6), or the second power supply cutting-off module 600 may be provided in different areas of the developer unit 200, for example, in an area including the corner of the left lower end of the developer unit 200 or in a predetermined area of the center of the lower end of the developer unit 200. The second protuberance 600*a* may be provided in the same area as the above-described first power supply cutting-off module 500 (refer to FIG. 6).

As described above, the device for cutting off the power supply of the printer according to one aspect of the present invention includes the first unit cutting off the power supply included in the developer unit, for example, the first protuberance or the second power supply cutting-off module, and the second unit cutting off power supply, provided on the surface of the printer cover opposite to the developer unit to correspond to the first unit, for example, the second protuberance or the first power supply cutting-off module.

Although a few embodiments of the present invention have been particularly shown and described, it will be appreciated by those skilled in the art that changes may be made therein in these embodiments without departing from the principles and spirit of the present invention, the scope or which is defined in the appended and their equivalents.

For example, the plurality of protuberances 200*a*, 200*b* may be provided in the developer unit, and the single power supply cutting-off module or the plurality of power supply cutting-off modules 500, 501 operated by the plurality of protuberances, inserted into insertion holes 120*c*, 501*c* may be provided in the printer cover (refer to FIG. 6). Alternatively, the plurality of protuberances 600*a*, 601*a* may be provided in the printer cover, and the single power supply cutting-off module or the plurality of power supply cutting-off modules 600, 601 having insertion holes 600*b*, 601*b* corresponding to the plurality of protuberances may be provided in the developer unit. In addition, the area around the protuberances may be in a shape other than a step shape, and the power supply cutting-off modules provided to match to the area around the protuberances.

As described above, according to the device for cutting off the power supply of the printer of the present invention, since the number of the elements included in the device is less than that of the conventional device for cutting off the power supply, the volume occupied by the device for cutting off the power supply is decreased, thereby allowing a small printer. Also, the number of failures of the device for cutting off the power supply generated when assembling the elements thereof, and malfunctioning problems generated when operating the device can be greatly reduced.

What is claimed is:

1. A device cutting off a power supply of a printer, the printer including a developer unit and a printer cover, the device comprising:

a first unit cutting off the power supply provided to the developer unit; and a second unit cutting off power supply provided on the surface of the printer cover opposite to the developer unit so as to correspond to the first unit, wherein the power supply is cut off upon opening of the printer cover, and the power supply is cut off upon the developer unit being separated from the printer, and the power supply is cut off upon an incomplete mounting of the developer unit in the printer.

2. The device of claim 1, wherein the first unit comprises a protuberance opposing the printer cover when the printer cover is closed and the developer unit is mounted in the printer.

3. The device of claim 1, wherein the second unit comprises a protuberance opposing the developer unit when the printer cover is closed and the developer unit is mounted in the printer.

4. The device of claim 1, wherein the first unit comprises a plurality of protuberances formed opposing the printer cover.

5. The device of claim 1, wherein the second unit comprises a plurality of protuberances formed so as to oppose the developer unit.

6. A device cutting off a power supply of a printer, the printer including a developer unit and a printer cover, the device comprising:

a first unit cutting off the power supply provided to the developer unit; and a second unit cutting off power supply provided on the surface of the printer cover opposite to the developer unit so as to correspond to the first unit, wherein the first unit comprises a protuberance opposing the printer cover when the printer cover is closed and the developer unit is mounted in the printer, and wherein the second unit comprises a power supply cutting-off module, wherein the power supply cutting-off module comprises:

a cap having an insertion hole into which the protuberance is insertable and a switch module switchable to an 'ON' state when the protuberance is inserted into the insertion hole.

7. The device of claim 6, wherein an area of the developer unit around the protuberance is step-shaped and a shape of the power supply cutting-off module matches the area.

8. The device of claim 6, wherein an area of the printer cover around the protuberance is step-shaped and a shape of the power supply cutting-off module matches the area.

9. The device of claim 6, wherein the protuberance is located in a corner of the developer unit, and the power supply cutting-off module is located in the printer cover such that the protuberance corresponds to the insertion hole.

10. A device according to claim 6, wherein the power supply cutting-off module further comprises:

a switch operating the switch module and extending from a connecting point end of the switch over the switch module surface a predetermined distance, and a power supply cutting-off button transferring operation of the switch to the switch module.

11. A device cutting off a power supply of a printer, the printer including a developer unit and a printer cover, the device comprising:

a first unit cutting off the power supply provided to the developer unit; and a second unit cutting off power supply provided on the surface of the printer cover opposite to the developer unit so as to correspond to the first unit, wherein the second unit comprises a protuberance opposing the developer unit when the printer cover is closed and the developer unit is mounted in the printer, and wherein the first unit comprises a power supply cutting-off module, wherein the power supply cutting-off module comprises:

a cap having an insertion hole into which the protuberance is insertable, and a switch module switchable to an 'ON' state when the protuberance is inserted into the insertion hole.

12. The device of claim 11, wherein the power supply cutting-off module is located in a corner of the developer unit, and the protuberance is located in the printer cover corresponding to the insertion hole.

13. The device according to claim 11, wherein the power supply cutting-off module further comprises:

a switch operating the switch module and extending from a connecting point end of the switch over the switch module surface a predetermined distance, and a power supply cutting-off button transferring operation of the switch to the switch module.

14. A device cutting off a power supply of a printer, the printer including a developer unit and a printer cover, the device comprising:

a first unit cutting off the power supply provided to the developer unit; and a second unit cutting off power supply provided on the surface of the printer cover opposite to the developer unit so as to correspond to the first unit, wherein the first unit comprises a plurality of protuberances formed opposing the printer cover, and wherein the second unit comprises a power supply cutting-off module, wherein the power supply cutting-off module comprises:

a cap having a plurality of insertion holes into which the plurality of protuberances are insertable, and a switch module switchable to an 'ON' state when the plurality of protuberances are inserted into the plurality of insertion holes.

15. The device of claim 14, wherein the plurality of protuberances are separated from one another and the power supply cutting-off module comprises a plurality of power supply cutting-off modules corresponding to the plurality of separated protuberances, respectively.

16. A device cutting off a power supply of a printer, the printer including a developer unit and a printer cover, the device comprising:

a first unit cutting off the power supply provided to the developer unit; and a second unit cutting off power supply provided on the surface of the printer cover opposite to the developer unit so as to correspond to the first unit.

wherein the second unit comprises a plurality of protuberances formed so as to oppose the developer unit, and wherein the first unit comprises a power supply cutting-off module, wherein the power supply cutting-off module comprises:

a cap having a plurality of insertion holes into which the plurality of protuberances are insertable, and a switch module switchable to an 'ON' state when the plurality of protuberances are inserted into the plurality of insertion holes.

17. The device of claim 16, wherein the plurality of protuberances are separated from one another, and the power supply cutting-off module includes a plurality of power supply cutting-off modules corresponding to the plurality of separated protuberances, respectively.

* * * * *

UNITED STATES PATENT AND TRADEMARK OFFICE

CERTIFICATE OF CORRECTION

PATENT NO. : 6,885,835 B2
DATED : April 26, 2005
INVENTOR(S) : In-sik Seo

It is certified that error appears in the above-identified patent and that said Letters Patent is hereby corrected as shown below:

Column 10,
Line 23, after "unit" change "." to -- , --.

Signed and Sealed this

Eleventh Day of April, 2006

JON W. DUDAS
*Director of the United States Patent and Trademark Office*